US010800175B2

(12) United States Patent
Le et al.

(10) Patent No.: US 10,800,175 B2
(45) Date of Patent: Oct. 13, 2020

(54) GAP SPITS AT PRINTHEADS

(71) Applicant: Hewlett-Packard Development Company, L.P., Spring, TX (US)

(72) Inventors: Huy Le, Corvallis, OR (US); Rudyani Binte Supati, Singapore (SG); Christie D Larson, Vancouver, WA (US); Dimitre L Staykov, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/325,882

(22) PCT Filed: Sep. 1, 2016

(86) PCT No.: PCT/US2016/049833
§ 371 (c)(1),
(2) Date: Feb. 15, 2019

(87) PCT Pub. No.: WO2018/044311
PCT Pub. Date: Mar. 8, 2018

(65) Prior Publication Data

US 2019/0210371 A1 Jul. 11, 2019

(51) Int. Cl.
*B41J 2/165* (2006.01)

(52) U.S. Cl.
CPC ..... *B41J 2/16526* (2013.01); *B41J 2/16508* (2013.01); *B41J 2002/16573* (2013.01)

(58) Field of Classification Search
CPC ..... B41J 2/16526; B41J 2/16508
See application file for complete search history.

(56) References Cited

U.S. PATENT DOCUMENTS 4,668,965 A * 5/1987 Tanaka ..... B41J 2/16579 347/17
5,847,727 A * 12/1998 VanLiew ..... B41J 2/16547 347/33
6,179,403 B1 1/2001 Xie et al.
6,960,036 B1 * 11/2005 Fujita ..... B41J 2/2135 400/120.01
9,016,830 B2 4/2015 Parazak et al.
9,028,039 B2 5/2015 Masaoka et al.
2001/0003349 A1 6/2001 Hosono
(Continued)

OTHER PUBLICATIONS

Y.J. Fang et al—"Modification of Heater and Bubble Clamping Behavior in Off-shooting Inkjet Ejector", IEEE Sensors 2005, 1 page (abstract only).

*Primary Examiner* — Jason S Uhlenhake
(74) *Attorney, Agent, or Firm* — HP Inc. Patent Department

(57) ABSTRACT

In one example of the disclosure, a printer includes a printhead having a set of nozzles. Printing ejection of marking agent is caused upon a media to print each of a set of pages of a print job. An initial page spit is caused to occur at the printhead prior to the printing engine causing printing of an initial page of the print job. A between-pages spit is caused to occur at the printhead between printing of pages of the print job. Responsive to a determination that a predetermined period between printing of a page and a consecutive page of the print job has been exceeded, a gap spit is caused to occur at the printhead in lieu of a between-pages spit.

14 Claims, 6 Drawing Sheets

(56) References Cited

U.S. PATENT DOCUMENTS

| | | | | |
|---|---|---|---|---|
| 2002/0101472 | A1 | 8/2002 | Tsuboi et al. | |
| 2002/0165685 | A1 | 11/2002 | Andersen et al. | |
| 2002/0196304 | A1 | 12/2002 | Gomez et al. | |
| 2006/0028502 | A1 | 2/2006 | Lee et al. | |
| 2007/0139487 | A1 | 6/2007 | Sekiguchi | |
| 2008/0084444 | A1 | 4/2008 | Sheahan et al. | |
| 2009/0322813 | A1 | 12/2009 | North et al. | |
| 2011/0285776 | A1 | 11/2011 | Osumi | |
| 2012/0075364 | A1* | 3/2012 | Nakazawa | B41J 2/16526 347/7 |
| 2013/0135380 | A1 | 5/2013 | Oonuki et al. | |
| 2014/0036002 | A1 | 2/2014 | Delametter et al. | |
| 2015/0258779 | A1* | 9/2015 | Ito | B41J 2/04573 347/9 |
| 2015/0266298 | A1* | 9/2015 | Kifuku | B41J 2/16508 347/9 |

* cited by examiner

GAP SPITS AT PRINTHEADS

BACKGROUND

Printing systems, such as inkjet printers, may include one or more printheads. Each printhead typically includes a printing surface having a series of nozzles that are used to spray drops of marking agent. During operation of the printing systems, the printing surface may accumulate contaminants such as dried or drying marking agent. Such contaminants can clog nozzles so as to severely affect the performance of the printing system and print quality.

DRAWINGS

DETAILED DESCRIPTION

Figure 1:
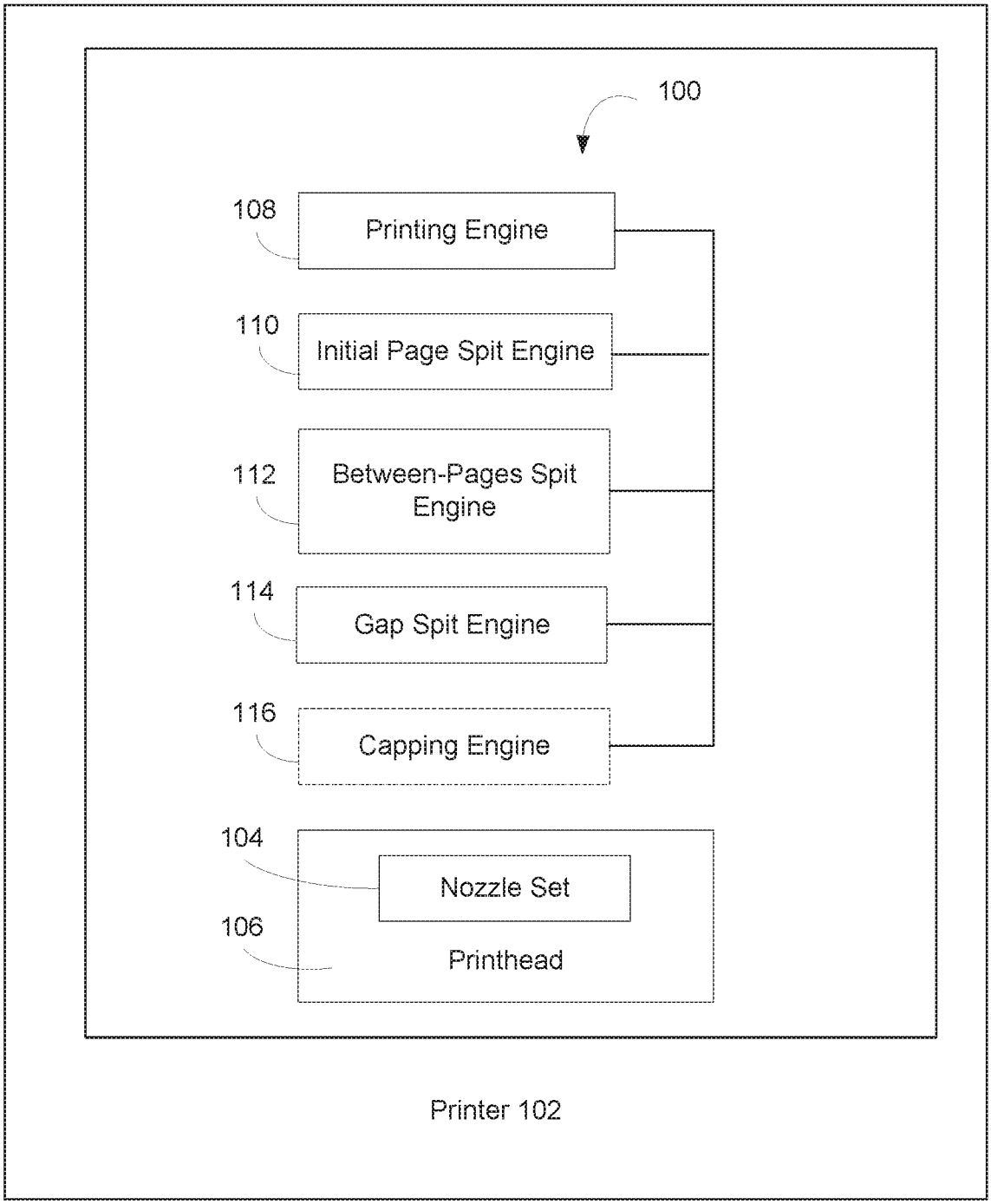
FIG. 1 is a block diagram depicting an example of a system to enable gap spits at a printhead.

One method of addressing the issue of accumulating contaminants is to periodically service the printhead to remove the contaminants/residue. Some printing systems include a service station that enable capping of printheads to prevent drying when inactive, and periodic cleaning the nozzles of the printhead by enabling ejecting marking agent into a spittoon, sponge, web, or other device at the service station designed to collect the ejected marking agent. Ejection of marking agent from a printhead for the purpose of cleaning or purging contaminants from the printhead is referred to herein as a "spit" or "spitting." In contrast, ejection of marking agent from a printhead upon a media or object for the purpose of creating a printed media or object is referred to herein as a "printing ejection." Many printers have automatic printhead servicing routines that provide for printhead spits as part of a de-capping operation to begin a new print job and/or as part of capping operation at the end of a print job. However, in some situations printhead spitting in association with capping and uncapping operations may not be optimal because the printhead temperature at these times is too cool relative to a target printing temperature. In some situations, spitting at a low temperature relative to the target printing temperature may fail to correct, or even exacerbate, pooling of marking agent that blocks or partially blocks nozzles of the printhead.

To address these issues, various examples described in more detail below provide a system method that enable performance of gap spits in order to purge contaminants from printhead nozzles. In an example, a printer may include a printhead (or multiple printheads) having a set of nozzles. A gap spit system at the printer is to cause the printer to eject marking agent through the nozzles upon a media to print each of a set of pages of a print job. The system is to cause an initial page spit to occur at the printhead prior to printing of an initial page of the print job. The system is to cause between-pages spits to occur at the printhead between printing of pages of the print job. The system is also, responsive to having determined that a predetermined period between printing of a page of the print job and a next page of the print job has been exceeded, to cause a gap spit to occur at the printhead in lieu of a between-pages spit.

In examples, the initial page spit, the between-pages spits, and the gap spit for the printhead are each to include a purging ejection of marking agent concurrently from each of the nozzles of the printhead. In certain examples, the predetermined time period may be a period of five or more seconds.

In examples, the initial page spit and the gap spit are to occur at a printhead temperature that is higher than a target printing temperature, and the between-pages spits are to occur at a printhead temperature at or below the target printing temperature. In certain examples, the initial page spit and the gap spit are to occur at a temperature up to 5 degrees higher than the target printing temperature, wherein between-pages spits are to occur at a temperature range between the target printing temperature and approximately 5 degrees below the target printing temperature. In particular examples, the target printing temperature is approximately 55 degrees Celsius. In particular examples, a gap spit is to occur at a printhead temperature between 55 degrees Celsius and 75 degrees Celsius wherein between pages spits are to occur at a printhead temperature between 50 degrees Celsius and 55 degrees Celsius.

In some examples, the disclosed and method may enable a capping of the printhead so as to cover each of the set of nozzles, with the capping to occur upon an occurrence of elapsing of a predetermined period since the printing of a last page of the print job. In certain examples, the predetermined period that when exceeded causes capping is between 30 and 50 seconds. In examples, the disclosed system and method do not cause a between-pages spit to occur following printing of a last page of the print job.

In this manner, then, an initial page spit and gap spits can occur at temperatures at or above the target printing temperature and thereby improve the purging of contaminants and reduction of marking agent pooling at the nozzles. Providing for an initial page spit and gap spits to occur at a temperature at or above target printing temperature in certain situations can allow the marking agent drops to be ejected at a lower viscosity and higher velocity than would occur with traditional automatic spitting operation systems. Users of printers and marking agents will enjoy the efficiency and ease of use made possible by the disclosed system and method for gap spitting at printheads, and utilization of printers that employ the disclosed system and method should be enhanced.

Figure 2:
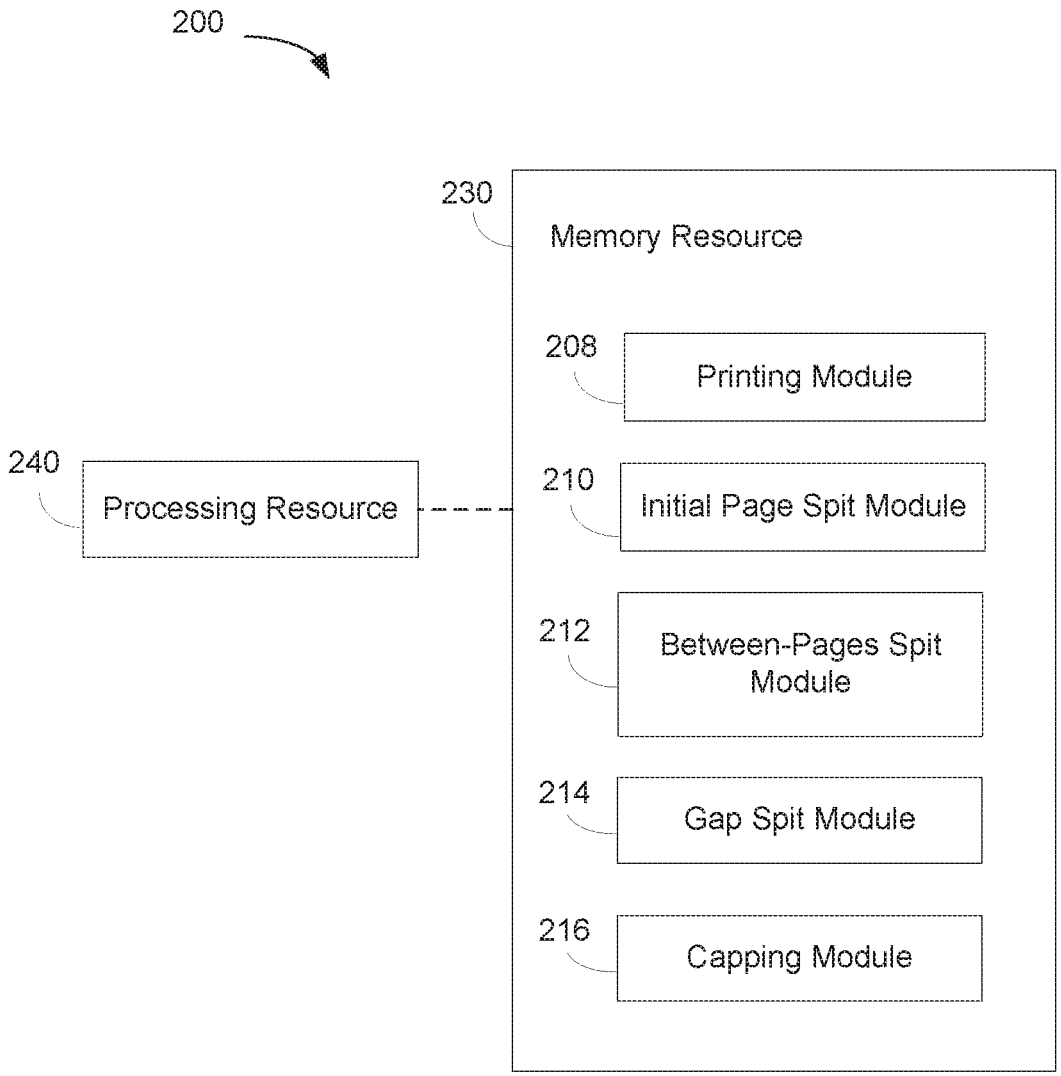
FIG. 2 is a block diagram depicting a memory resource and a processing resource to implement examples of gap spits at a printhead.

FIGS. 1 and 2 depict examples of physical and logical components for implementing various examples. In FIG. 1 various components are identified as engines 108, 110, 112, 114, and 116. In describing engines 108-116 focus is on each engine's designated function. However, the term engine, as used herein, refers generally to a combination of hardware and programming to perform a designated function. As is illustrated later with respect to FIG. 2, the hardware of each engine, for example, may include one or both of a processor and a memory, while the programming may be code stored on that memory and executable by the processor to perform the designated function.

FIG. 1 is a block diagram depicting components of a system 100 at a printer 102 to enable gap spitting at a printhead. In this example, printer 102 includes a printhead 106, with the printhead 106 having a set of nozzles 104. As used herein, a "printer" is synonymous with a "printing device", and refers generally to any electronic device or group of electronic devices that consume a marking agent to produce a printed print job or printed content. In examples, a printer may be, but is not limited to, a liquid inkjet printer, a solid toner-based printer, a liquid toner-based printer, or a multifunctional device that performs a function such as scanning and/or copying in addition to printing. As used herein, a "print job" refers generally to content, e.g., an image, and/or instructions as to formatting and presentation of the content sent to a computer system for printing. In examples, a print job may be stored in a programming language and/or a numerical form so that the job can be stored and used in computing devices, servers, printers and other machines capable of performing calculations and manipulating data. As used herein, an "image" refers generally to a rendering of an object, scene, person, or abstraction such text or a geometric shape. In certain examples, a "printer" may be a 3D printer. In certain examples, the printed print job or printed content may be a 3D rendering created by a 3D printer printing upon a bed of marking agent or other build material.

In this example, system 100 at printer 102 includes printing engine 108, initial page spit engine 110, between-pages spit engine 112, gap spit engine 114, and capping engine 116. In performing their respective functions, engines 108-116 may access a data repository, e.g., a memory accessible to system 100 that can be used to store and retrieve data.

In an example, printing engine 108 represents generally a combination of hardware and programming to cause a printing ejection of marking agent through a printhead upon a media to print each of a set of pages of a print job. As used herein, "marking agent" refers generally to any substance that can be applied upon a media by a printer during a printing operation, including but not limited to aqueous inks, solvent inks, UV-curable inks, dye sublimation inks, latex inks, liquid electrophotographic inks, liquid or solid toners, and powders. An "ink" refers generally to any fluid that is to be applied to a media during a printing operation. As used herein, a "printhead" refers generally to a mechanism having a plurality of nozzles through which a marking agent is ejected. Examples of printheads are drop on demand inkjet printheads, such as piezoelectric printheads and thermo resistive printheads. Some printheads may be part of a cartridge which also stores the marking agent to be dispensed. Other printheads are standalone and are supplied with marking agent by an off-axis marking agent supply. As used herein, a "media" and "print media" are used synonymously and may include a pre-cut media, a continuous roll or web media, or any other article or object on which a printed image can be formed. As used herein a "page" of a print job refers generally to a sheet or other incidence of media (e.g., an incidence of a pre-cut media, an incidence of a continuous roll or web media, or an incidence of any other article or object) upon which a portion of the print job is to be printed. In a particular example, printing engine 208 is to cause the printing ejection of marking agent upon the media to print the pages of the print job at a target printing temperature of approximately 55 degrees Celsius. As used herein, "target printing temperature" refers generally to a predetermined temperature or temperature range at which printing ejection of marking agent from a printhead is to occur.

Initial page spit engine 110 represents generally a combination of hardware and programming to cause an initial page spit to occur at the printhead prior to the printing engine 108 causing printing of the initial page of a print job. In examples, the initial page spit is a purging ejection of marking agent concurrently from each of the set of nozzles of the printhead. In examples, the initial page spit may be to eject marking agent into a spittoon, sponge, web, or other device at a service station component of the printer designed to collect the purging ejection of marking agent. In examples, the initial page spit is to occur at a printhead temperature that is higher than the target printing temperature. In a particular example, the initial page spit is to occur at a temperature up to 5 degrees higher than the target printing temperature. In another particular example, the initial page spit is to occur at a temperature between 55.01 degrees Celsius and 75 degrees Celsius.

Between-pages spit engine 112 represents generally a combination of hardware and programming to cause between-pages spits to occur at the printhead 106 between printing of pages of the print job. As with the initial page spit, and with the gap spit discussed in detail in subsequent paragraphs, the between-pages spit may be a purging ejection of marking agent concurrently from each of the nozzles of the printhead. However, unlike the initial page spit and the gap spits, between-pages spits are to occur at a temperature less than the target printing temperature. In certain examples, between-pages spits are to occur at a temperature range between the target printing temperature and approximately 5 degrees below the target printing temperature. In particular examples, between pages spits are to occur at a printhead temperature between 50 degrees Celsius and 55 degrees Celsius.

Gap spit engine 110 represents generally a combination of hardware and programming to, responsive to a determination that a predetermined period between printing of a page N and consecutive page N+1 of the print job has been exceeded, cause a gap spit to occur at the printhead in lieu of a between-pages spit between printing of the page N+1 and the immediately previous page N. In examples, gap spit engine 114 is to make the determination that the predetermined period has been exceeded based upon data obtained by gap spit engine 114. In other examples, the determination that the predetermined period has been exceeded may be made by another engine or component of system 112, with gap spit engine 114 obtaining data indicative of the determination. In an example, the predetermined period is a period that has allowed the printhead to cool such that the printhead temperature is less than the target printing temperature. In a particular example, the predetermined period is a period of five or more seconds between printing of the page N and the page N+1 of the print job.

In examples, as with the initial page spit and the between-pages spits, the gap spit for the printhead may be a purging ejection of marking agent concurrently from each of the nozzles of the printhead. And like the initial page spit, the gap spit is to occur at a printhead temperature that is higher than the target printing temperature. In examples, the gap spits are to occur at a temperature up to 5 degrees higher than the target printing temperature. In a particular examples, gap spits may occur at a printhead temperature that is between 55 degrees Celsius and 75 degrees Celsius, and may be spit that is purge ejection of between 9 and 11 drops per nozzle of the printhead. In examples, gap spit engine 114, upon determination of exceeding of the predetermined period, may send an instruction to between-pages spit engine 112 such that between-pages engine 112 does not to cause a between-pages spit following printing of a last page of the print job.

In some examples, gap spit system 102 may include a capping engine 116. Capping engine 116 represents generally a combination of hardware and programming to cause a capping of the printhead, so as to cover each of the set of nozzles of the printhead, upon an occurrence of elapsing of a predetermined period since the printing of a last page of the print job. As used herein, to "cap" or "capping" of a printhead refers to a covering of the nozzle set of the printhead so as to inhibit drying of marking agent on the surface of or within the printhead. In examples the capping occurs at a service station component of the printer 102. In examples, the covering is a concurrent covering of all of the nozzle set 104 by a capping device made that includes a polymer or other flexible or semi-rigid material so as to effectively cover and seal the nozzles of the nozzle set 104. In examples, the predetermined period since the printing of a last page of the print job is a period between 30 and 50 seconds. In this manner, capping is to occur during a substantial period of inactivity with respect to printing operations to avoid the marking agent at the printhead losing viscosity.

In the foregoing discussion of FIG. 1, engines 108-116 were described as combinations of hardware and programming. Engines 108-116 may be implemented in a number of fashions. Looking at FIG. 2 the programming may be processor executable instructions stored on a tangible memory resource 230 and the hardware may include a processing resource 240 for executing those instructions. Thus memory resource 230 can be said to store program instructions that when executed by processing resource 240 implement system 100 of FIG. 1.

Memory resource 230 represents generally any number of memory components capable of storing instructions that can be executed by processing resource 240. Memory resource 230 is non-transitory in the sense that it does not encompass a transitory signal but instead is made up of a memory component or memory components to store the relevant instructions. Memory resource 230 may be implemented in a single device or distributed across devices. Likewise, processing resource 240 represents any number of processors capable of executing instructions stored by memory resource 230. Processing resource 240 may be integrated in a single device or distributed across devices. Further, memory resource 230 may be fully or partially integrated in the same device as processing resource 240, or it may be separate but accessible to that device and processing resource 240.

In one example, the program instructions can be part of an installation package that when installed can be executed by processing resource 240 to implement system 100. In this case, memory resource 230 may be a portable medium such as a CD, DVD, or flash drive or a memory maintained by a server from which the installation package can be downloaded and installed. In another example, the program instructions may be part of an application or applications already installed. Here, memory resource 230 can include integrated memory such as a hard drive, solid state drive, or the like.

In FIG. 2, the executable program instructions stored in memory resource 230 are depicted as printing module 208, initial page spit module 210, between-pages spit module 212, gap spit module 214, and capping module 216. Printing module 208 represents program instructions that when executed by processing resource 240 may perform any of the functionalities described above in relation to printing engine 108 of FIG. 1. Initial page spit module 210 represents program instructions that when executed by processing resource 240 may perform any of the functionalities described above in relation to initial page spit engine 110 of FIG. 1. Between-pages spit module 212 represents program instructions that when executed by processing resource 240 may perform any of the functionalities described above in relation to between-pages spit engine 112 of FIG. 1. Gap spit module 214 represents program instructions that when executed by processing resource 240 may perform any of the functionalities described above in relation to gap spit engine 114 of FIG. 1. Capping module 216 represents program instructions that when executed by processing resource 240 may perform any of the functionalities described above in relation to capping engine 116 of FIG. 1.

Figure 3:
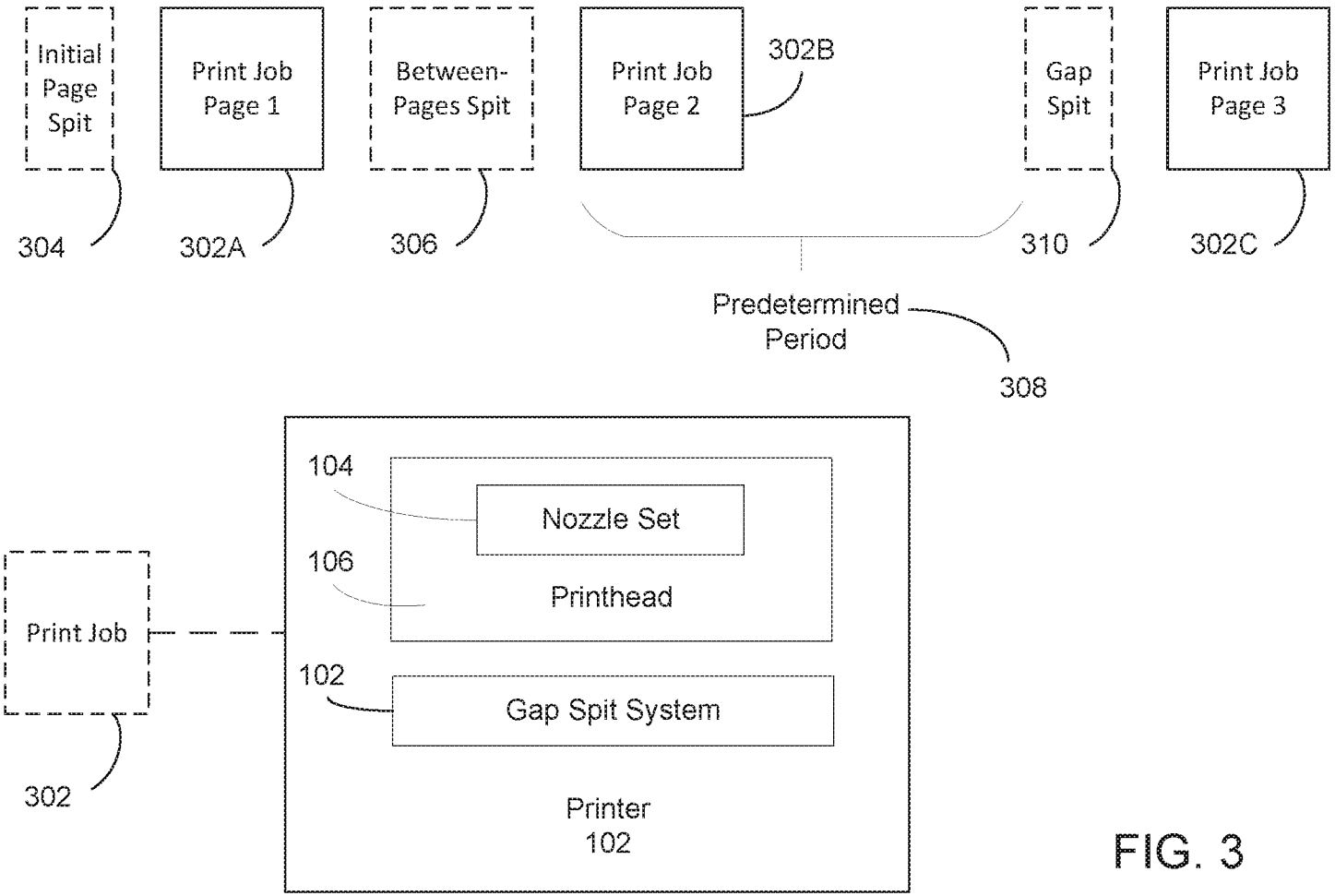
FIG. 3 illustrates an example of gap spitting at a printhead.

FIG. 3, in view of FIGS. 1, and 2, illustrates an example of gap spitting at a printhead. In this example, a printer 102 includes a printhead 106 with a set of nozzles 104 and a gap spit system 100. Printer 102 receives a print job 302, e.g., via a network from a client computing device or a server. Print job 302 includes three pages to be printed—a print job page 1 302A, print job page 2 302B, and print job page 3 302C.

Gap spit system 102 causes an initial page spit 304 to occur concurrently for each of the set of nozzles 104 of printhead 106 prior to printing of print job page 1 302A. This initial page spit 304 occurs while the printhead 106 is at a temperature that is higher than a target printing temperature for the printhead 106 and/or the printing operation. In certain examples, the initial page spit 304 is to occur at a temperature up to 5 degrees higher than the target printing temperature. In certain examples, the target printing temperature is approximately 55 degrees Celsius. Gap spit system 100, after the initial page spit 304, causes a printing ejection of marking agent from the set of nozzles 106 upon a media to print print job page 1 302A. The printing ejection is to occur at the target printing temperature.

Continuing with the example of FIG. 3, gap spit system 102 causes a between-pages spit 306 to occur concurrently for each of the set of nozzles 104 of the printhead 106 between printing of print job page 1 302A and print job page 2 302B at a temperature that is at or lower than the target printing temperature. In certain examples, the between-pages spit 306 is to occur at a temperature range between the target printing temperature and approximately 5 degrees below the target printing temperature. Following the between-pages spit 306, gap spit system 100 causes a printing ejection (e.g., while the printhead temperature is at the target printhead temperature) of marking agent from the set of nozzles 106 upon a media to print print job page 2 302B.

Gap spit system 102 determines that, with respect to the printing of print job page 2 302B and print job page 3 302C, a predetermined acceptable period 308 between printing of pages of the print job 302 has been exceeded, and in response to such determination causes a gap spit 310 to occur at the printhead 106 between printing of print job page 2 302B and print job page 3 302C. In certain examples the predetermined time period 308 is a period of five or more seconds. The gap spit 310 occurs at a printhead temperature that is greater than the target printing temperature. This gap spit 310 between print job page 2 302B and print job page 3 302C replaces a between-pages spit (at a printhead temperature at or below the target printing temperature) that would have occurred between print job page 2 302B and print job page 3 302C had the predetermined period 308 not been exceeded. In certain examples, the gap spit 310 is to occur at a temperature up to 5 degrees higher than the target printing temperature.

Continuing with the example of FIG. 3, following the gap spit 310, gap spit system 100 causes a printing ejection of marking agent from the set of nozzles 106 upon the media to print print job page 3 302C, the last page of the print job 302 in this example. The printing ejection is to occur at the target printing temperature.

In particular examples, after an elapsing of a predefined period since the printing of print job page 3 302C, gap spit system 100 may cause a capping of printhead 106 so as to cover each of the set of nozzles 104. In examples the predefined time period that when exceeded may initiate printhead capping is a period of five or more seconds.

Figure 4:
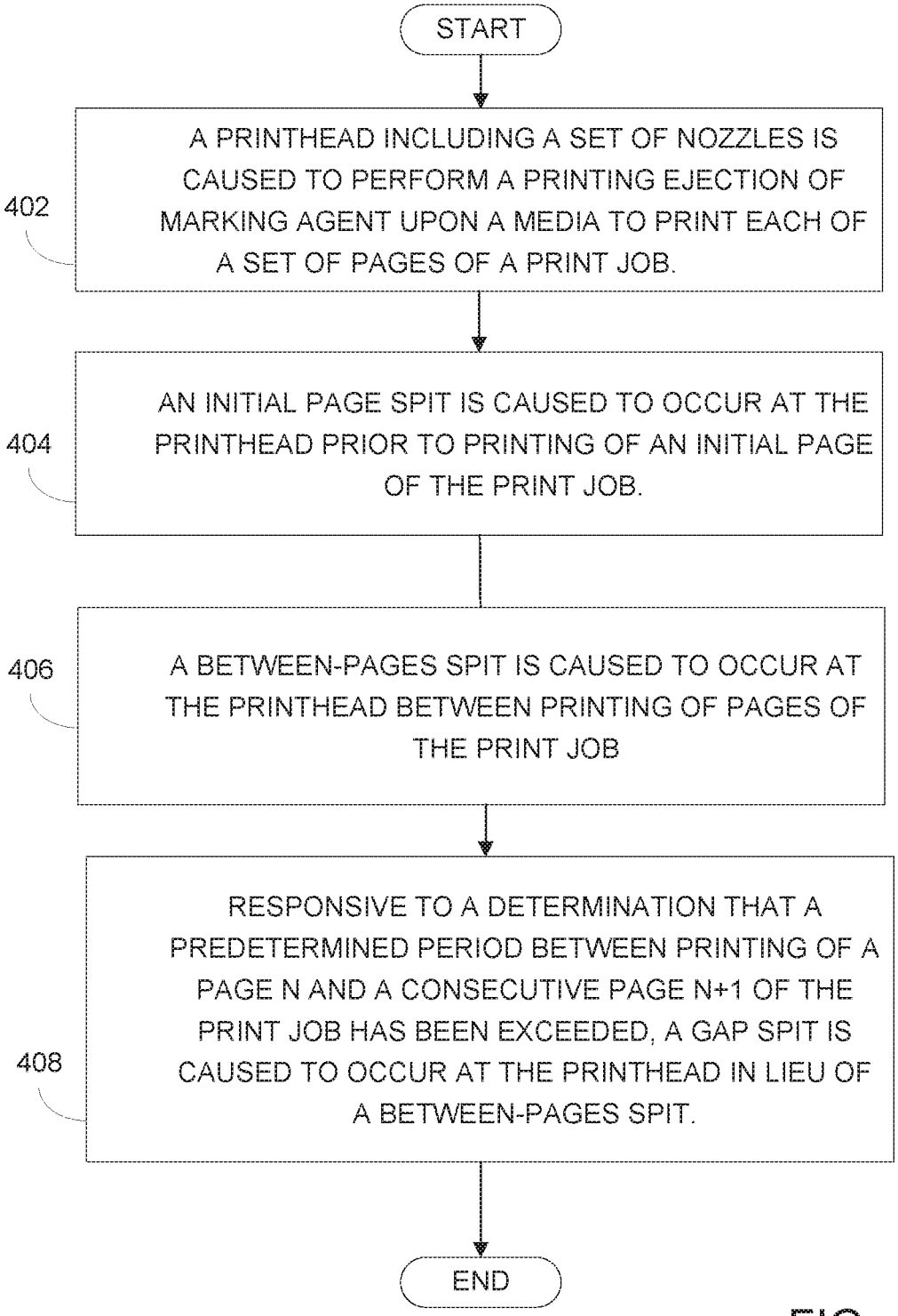
FIG. 4 is a flow diagram depicting implementation of an example of gap spits at a printhead.

FIG. 4 is a flow diagram of implementation of a method for causing gap spits at printheads. In discussing FIG. 4, reference may be made to the components depicted in FIGS. 1 and 2. Such reference is made to provide contextual examples and not to limit the manner in which the method depicted by FIG. 4 may be implemented. A printhead including a set of nozzles is caused to perform a printing ejection of marking agent upon a media to print each of a set of pages of a print job (block 402). Referring back to FIGS. 1 and 2, printing engine 108 (FIG. 1) or printing module 208 (FIG. 2), when executed by processing resource 240, may be responsible for implementing block 402.

An initial page spit is caused to occur at the printhead prior to printing of an initial page of the print job (block 404). Referring back to FIGS. 1 and 2, initial page spit engine 110 (FIG. 1) or initial page spit module 210 (FIG. 2), when executed by processing resource 240, may be responsible for implementing block 404.

A between-pages spits are caused to occur at the printhead between printing of pages of the print job (block 406). Referring back to FIGS. 1 and 2, between-pages spit engine 112 (FIG. 1) or between-pages spit module 212 (FIG. 2), when executed by processing resource 240, may be responsible for implementing block 406.

Responsive to a determination that a predetermined period between printing of a page N and a consecutive page N+1 of the print job has been exceeded, a gap spit is caused to occur at the printhead in lieu of a between-pages spit between printing of the page N and the page N+1 (block 408). Referring back to FIGS. 1 and 2, gap spit engine 114 (FIG. 1) or gap spit module 214 (FIG. 2), when executed by processing resource 240, may be responsible for implementing block 408.

Figure 5:
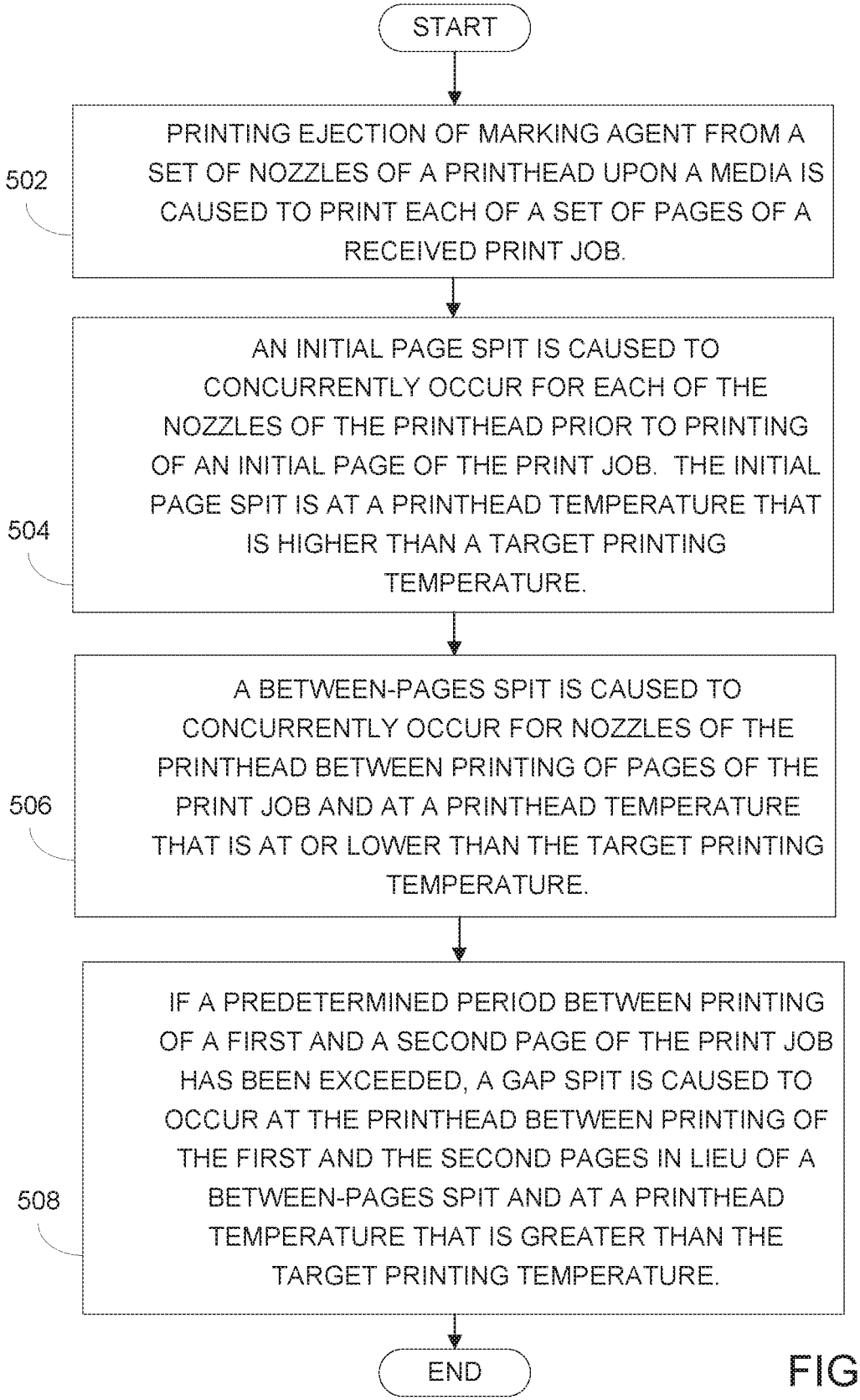
FIG. 5 is a flow diagram depicting implementation of an example of causing gap spits at a printhead, the method including causing a between-pages spit to occur at a printhead temperature that is at or lower than the target printing temperature, and causing a gap spit to occur at a printhead temperature that is greater than the target printing temperature.

FIG. 5 is a flow diagram of implementation of a method for causing gap spits at printheads. In discussing FIG. 5, reference may be made to the components depicted in FIGS. 1 and 2. Such reference is made to provide contextual examples and not to limit the manner in which the method depicted by FIG. 5 may be implemented. Printing ejection of marking agent from a set of nozzles of a printhead upon a media is caused to print each of a set of pages of a received print job (block 502). Referring back to FIGS. 1 and 2, printing engine 108 (FIG. 1) or printing module 208 (FIG. 2), when executed by processing resource 240, may be responsible for implementing block 502.

An initial page spit is caused to concurrently occur for each of the nozzles of the printhead prior to printing of an initial page of the print job. The initial page spit is at a printhead temperature that is higher than a target printing temperature (block 504). Referring back to FIGS. 1 and 2, initial page spit engine 110 (FIG. 1) or initial page spit module 210 (FIG. 2), when executed by processing resource 240, may be responsible for implementing block 504.

A between-pages spit is caused to concurrently occur for nozzles of the printhead between printing of pages of the print job and at a printhead temperature that is at or lower than the target printing temperature (block 506). Referring back to FIGS. 1 and 2, between-pages spit engine 112 (FIG. 1) or between-pages spit module 212 (FIG. 2), when executed by processing resource 240, may be responsible for implementing block 506.

If a predetermined period between printing of a first and a second page of the print job has been exceeded, a gap spit is caused to occur at the printhead between printing of the first and the second pages in lieu of a between-pages spit and at a printhead temperature that is greater than the target printing temperature (block 508). Referring back to FIGS. 1 and 2, gap spit engine 114 (FIG. 1) or gap spit module 214 (FIG. 2), when executed by processing resource 240, may be responsible for implementing block 508.

Figure 6:
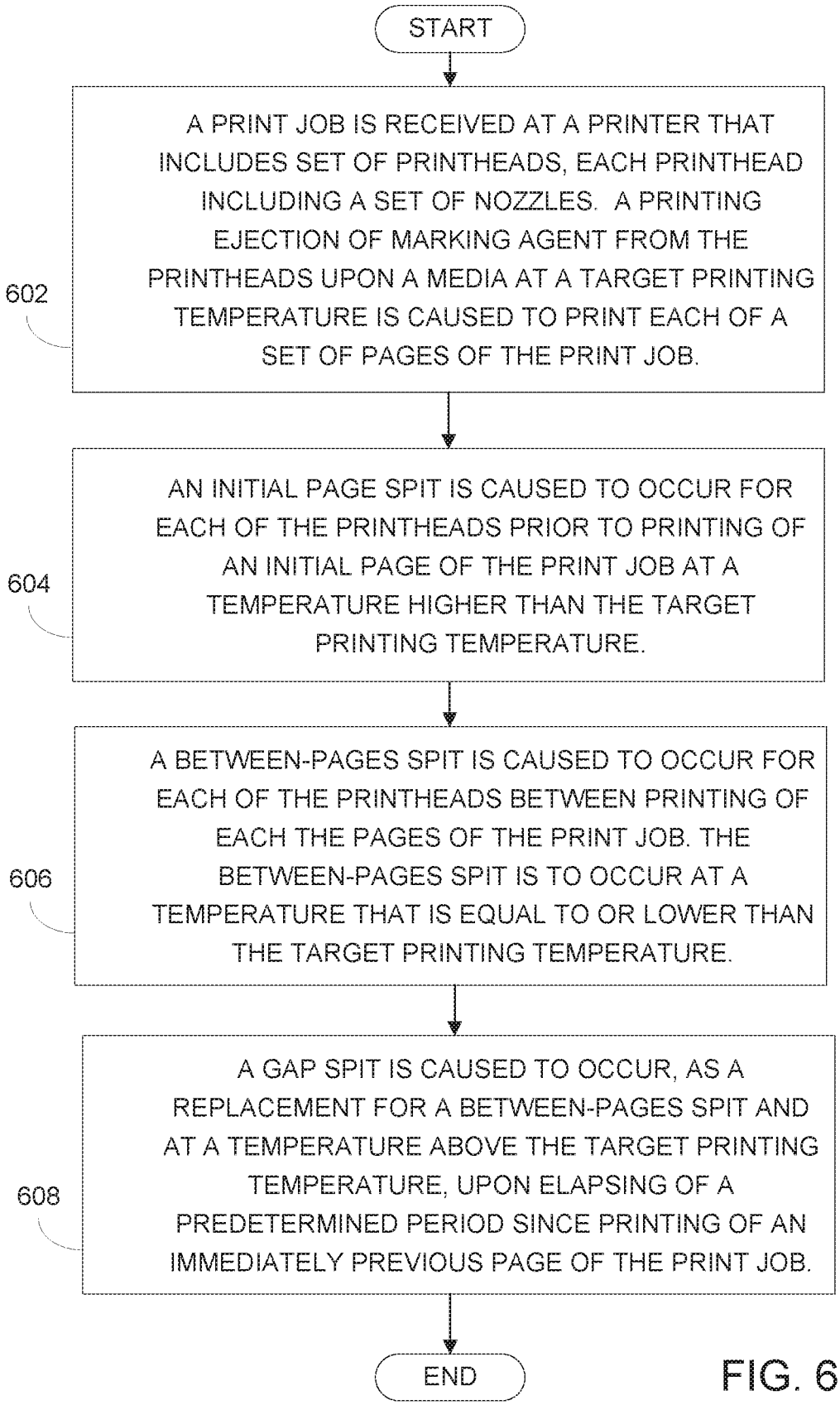
FIG. 6 is a flow diagram depicting implementation of an example of gap spits at a printhead, wherein a print job is received at a printer having multiple printheads and an initial page spit, a between-pages spit, and a gap spit are performed for each of the printheads.

FIG. 6 is a flow diagram of implementation of a method for causing gap spits at printheads. In discussing FIG. 6, reference may be made to the components depicted in FIGS. 1 and 2. Such reference is made to provide contextual examples and not to limit the manner in which the method depicted by FIG. 6 may be implemented. A print job is received at a printer that includes set of printheads, each printhead including a set of nozzles. A printing ejection of marking agent from the printheads upon a media at a target printing temperature is caused to print each of a set of pages of the print job (block 602). Referring back to FIGS. 1 and 2, printing engine 108 (FIG. 1) or printing module 208 (FIG. 2), when executed by processing resource 240, may be responsible for implementing block 602.

An initial page spit is caused to occur for each of the printheads prior to printing of an initial page of the print job at a temperature higher than the target printing temperature (block 604). Referring back to FIGS. 1 and 2, initial page spit engine 110 (FIG. 1) or initial page spit module 210 (FIG. 2), when executed by processing resource 240, may be responsible for implementing block 604.

A between-pages spit is caused to occur for each of the printheads between printing of each the pages of the print job, the between-pages spit to occur at a temperature that is equal to or lower than the target printing temperature (block 606). Referring back to FIGS. 1 and 2, between-pages spit engine 112 (FIG. 1) or between-pages spit module 212 (FIG. 2), when executed by processing resource 240, may be responsible for implementing block 606.

A gap spit is caused to occur, as a replacement for a between-pages spit and at a temperature above the target printing temperature, upon elapsing of a predetermined period since printing of an immediately previous page of the print job (block 608). Referring back to FIGS. 1 and 2, gap spit engine 114 (FIG. 1) or gap spit module 214 (FIG. 2), when executed by processing resource 240, may be responsible for implementing block 608.

FIGS. 1-6 aid in depicting the architecture, functionality, and operation of various examples. In particular, FIGS. 1 and 2 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagrams of FIGS. 4-6 show specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive.

What is claimed is:

1. A printer, comprising:

a printhead including a set of nozzles;

a printing engine, to cause printing ejection of marking agent upon a media to print each of a set of pages of a print job;

an initial page spit engine, to cause an initial page spit to occur at the printhead prior to the printing engine causing printing of an initial page of the print job;

a between-pages spit engine, to cause a between-pages spit to occur at the printhead between printing of pages of the print job; and a gap spit engine, to, responsive to a determination that a predetermined period between printing of a page N and a consecutive page N+1 of the print job has been exceeded, cause a gap spit to occur at the printhead in lieu of a between-pages spit, wherein the initial page spit and the gap spit are at a printhead temperature higher than a target printing temperature, and the between-pages spits are to occur at a printhead temperature at or below the target printing temperature.

2. The printer of claim 1, wherein the initial page spit, the between-pages spits, and the gap spit for the printhead are to include a purging ejection of marking agent concurrently from each of the nozzles of the printhead.

3. The printer of claim 1, wherein the predetermined time period is five or more seconds.

4. The printer of claim 1, wherein the gap spit is to occur at a printhead temperature between 55 degrees Celsius and 75 degrees Celsius.

5. The printer of claim 1, wherein the initial page spit and the gap spit are to occur at a temperature up to 5 degrees higher than the target printing temperature.

6. The printer of claim 1, wherein the between-pages spits are to occur at a temperature range between the target printing temperature and approximately 5 degrees below the target printing temperature.

7. The printer of claim 1, wherein the between pages spits are to occur at a printhead temperature between 50 degrees Celsius and 55 degrees Celsius.

8. The printer of claim 1, wherein the target printing temperature is approximately 55 degrees Celsius.

9. The printer of claim 1, wherein the predetermined time period is a first predetermined time period, and further comprising a capping engine, to cause a capping of the printhead so as to cover each of the set of nozzles, the capping to occur upon an occurrence of elapsing of a second predetermined period since the printing of a last page of the print job.

10. The printer of claim 9, wherein the second predetermined period is between 30 and 50 seconds.

11. The printer of claim 1, wherein the gap spit is between 9 and 11 drops per nozzle.

12. The printer of claim 1, wherein the between-pages spit engine is not to cause a between-pages spit following printing of a last page of the print job.

13. A memory resource storing instructions that when executed cause a processing resource to effect a printing at a printer, the instructions comprising:

a printing module that when executed causes the processing resource to cause printing ejection of marking agent from a set of nozzles of a printhead upon a media to print each of a set of pages of a received print job;

an initial page spit module that when executed causes the processing resource to cause an initial page spit to concurrently occur for each of the nozzles of the printhead prior to printing of an initial page of the print job and at a printhead temperature that is higher than a target printing temperature;

a between-pages spit module that when executed causes the processing resource to cause a between-pages spit to concurrently occur for nozzles of the printhead between printing of pages of the print job and at a printhead temperature that is at or lower than the target printing temperature; and a gap spit module that when executed causes the processing resource to, if a predetermined period between printing of a first and a second page of the print job has been exceeded, cause a gap spit to occur at the printhead between printing of the first and the second pages in lieu of a between-pages spit and at a printhead temperature that is greater than the target printing temperature.

14. A printing method, comprising:

receiving a print job at a printer that includes set of printheads, each printhead including a set of nozzles;

causing printing ejection of marking agent from the printheads upon a media at a target printing temperature to print each of a set of pages of the print job;

causing an initial page spit to occur for each of the printheads prior to printing of an initial page of the print job at a temperature higher than the target printing temperature;

causing a between-pages spit to occur for each of the printheads between printing of each the pages of the print job, the between-pages spit to occur at a temperature that is equal to or lower than the target printing temperature; and causing a gap spit to occur, as a replacement for a between-pages spit and at a temperature above the target printing temperature, upon elapsing of a predetermined period since printing of an immediately previous page of the print job.

* * * * *